US010518959B2

(12) United States Patent
Alvarez De La Cadena et al.

(10) Patent No.: US 10,518,959 B2
(45) Date of Patent: Dec. 31, 2019

(54) DISPENSER DEVICE

(71) Applicant: PHILIP MORRIS PRODUCTS S.A., Neuchatel (CH)

(72) Inventors: Antonio Alvarez De La Cadena, Benito Juarez (MX); Willem Paul Beeker, Ke Eindhoven (NL); Ahmet Dincer, Le Mont-sur-Lausanne (CH); Natasa Milosevic, Rome (IT)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/307,591

(22) PCT Filed: Jul. 6, 2017

(86) PCT No.: PCT/EP2017/067032
§ 371 (c)(1),
(2) Date: Dec. 6, 2018

(87) PCT Pub. No.: WO2018/007563
PCT Pub. Date: Jan. 11, 2018

(65) Prior Publication Data

US 2019/0202622 A1 Jul. 4, 2019

(30) Foreign Application Priority Data

Jul. 7, 2016 (EP) ..... 16178464

(51) Int. Cl.
*B65D 83/00* (2006.01)
*B65D 83/04* (2006.01)

(52) U.S. Cl.
CPC ..... *B65D 83/0409* (2013.01); *B65D 83/0005* (2013.01)

(58) Field of Classification Search
None
See application file for complete search history.

(56) References Cited

U.S. PATENT DOCUMENTS 2,294,001 A * 8/1942 Ritter ..... B65D 83/0409 206/537
2,718,299 A 9/1955 Atwater
2,772,772 A * 12/1956 Taylor ..... B43K 29/20 206/537

(Continued)

FOREIGN PATENT DOCUMENTS

KR 200415343 5/2006
WO WO 2013/000967 1/2013

(Continued)

OTHER PUBLICATIONS

European Extended Search Report for Application No. 16178464.0 dated Dec. 15, 2016.

(Continued)

*Primary Examiner* — Jacob S. Scott
*Assistant Examiner* — Ayodeji T Ojofeitimi
(74) *Attorney, Agent, or Firm* — Mueting, Raasch & Gebhardt, P.A.

(57) ABSTRACT

A dispenser for dispensing a filter component is provided. The dispenser comprises a housing (2) defining an exit orifice (5) and a rod (3) at least partially disposed within the housing. The rod has a first end face (301), and the rod is movable between a retracted position in which the first end face of the rod is fully disposed within the housing, and an extended position in which the first end face of the rod is disposed outside the housing. When the rod is moved between the retracted position and the extended position, the first end face (301) of the rod passes through the exit orifice (5).

14 Claims, 8 Drawing Sheets

(56) References Cited

U.S. PATENT DOCUMENTS 2,885,116 A * 5/1959 Tregilgas ..... B65D 83/0409 221/198
2,893,599 A * 7/1959 Kay ..... B65D 83/0409 221/260
3,398,857 A 8/1968 Alio
3,591,043 A * 7/1971 Murphy ..... B65D 83/0436 221/14
3,854,625 A * 12/1974 Kuebler ..... B65D 83/0409 221/198
4,113,143 A * 9/1978 Spagnola, Jr. ..... A63F 11/0002 221/267
4,244,308 A * 1/1981 Vince ..... A01C 7/16 111/89
4,413,760 A * 11/1983 Paton ..... A61M 5/3158 222/309
4,807,757 A * 2/1989 Rappaport ..... B65D 83/0409 206/534
5,011,317 A * 4/1991 Gueret ..... A45D 40/02 401/179
5,366,113 A * 11/1994 Kim ..... A61J 7/0076 206/537
6,889,869 B2 * 5/2005 Hallin ..... B65D 83/0418 221/223
8,308,026 B2 * 11/2012 Rapko ..... B25B 9/00 206/37
9,016,516 B2 * 4/2015 Ortenzi ..... A61J 7/0076 206/537
2011/0011884 A1 * 1/2011 Kindel ..... B65D 83/0409 221/279

FOREIGN PATENT DOCUMENTS

WO WO 2013/045265 4/2013
WO WO 2015/151158 10/2015

OTHER PUBLICATIONS

PCT/EP2017/067032 Search Report and Written Opinion dated Sep. 5, 2017 (8 pages).

* cited by examiner 1
2
3
4
5
7
9
601
602
603
604
605
607
608

DISPENSER DEVICE

This application is a U.S. National Stage Application of International Application No. PCT/EP2017067032 filed Jul. 6, 2017, which was published in English on Jan. 11, 2018, as International Publication No. WO 2017/007563 A1. International Application No. PCT/EP2017/067032 claims priority to European Application No. 16178464.0 filed Jul. 7, 2016.

The present invention relates to a dispenser for dispensing a filter component, and in particular, a dispenser for dispensing a filter component for a smoking article.

Filter cigarettes typically comprise a rod of tobacco cut filler surrounded by a paper wrapper and a cylindrical filter aligned in and end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It is known to incorporate additives, such as flavourants, into smoking articles in order modify the smoking experience for a consumer. One known way to incorporate additives, such as flavourants, into a smoking article is in the form of a crushable capsule. The capsules typically comprise a frangible wall enclosing a liquid additive. A consumer can apply a force to the capsule to rupture the wall and thus release the additive, thereby allowing a consumer to modify their smoking experience.

However, such capsules are incorporated into a smoking article during manufacture, for example, by embedding them in a segment of fibrous filtration material, such as cellulose acetate tow. Consequently, a consumer is restricted to additives that are already provided as part of the manufactured smoking article.

It would therefore be desirable to improve the means by which a consumer can customise their smoking experience, and in particular, customise the type of additive or flavour that they can use when smoking a smoking article.

According to a first aspect of the invention, there is provided a dispenser for dispensing a filter component. The dispenser comprises a housing defining an exit orifice and a rod at least partially disposed within the housing. The rod has a first end face, and the rod is movable between a retracted position in which the first end face of the rod is fully disposed within the housing, and an extended position in which the first end face of the rod is disposed outside the housing. When the rod is moved between the retracted position and the extended position, the first end face of the rod passes through the exit orifice.

The dispenser of the present invention allows a consumer to insert a filter component into a filter of a smoking article, and thereby provides them with the ability to customise the smoking experience obtained from said smoking article. For example, if the filter component is a flavour capsule, the dispenser can allow a consumer to choose a specific flavour capsule that they wish to use with a specific smoking article depending on the desired customised experience they wish to obtain.

The ability of the rod to be disposed outside the housing when the rod is in the extended position allows the rod to continue to push a filter component even when the filter component has passed out of the dispenser. This is particularly advantageous where the filter component is to be inserted into a smoking article. For example, the smoking article filter may include a mouth end recess into which the filter component needs to be inserted. The fact that the rod is able to extend from the dispenser enables it to push the filter component directly into the recess. This is particularly advantageous where the recess includes a narrow mouth end portion which the filter component must pass through as it enters the recess. In such circumstances, the rod is able to push the filter component through the narrow mouth end portion of the recess as it moves towards its fully extended position.

The provision of a rod that extends outside the housing also means that a single filter component is able to be pushed out of the dispenser and continue to be pushed into a recess of a smoking article without necessarily requiring any other filter components to leave the dispenser at the same time. This is advantageous where there may only be space in the smoking article for a single filter component. Where there is space for more than one filter component in the recess, this provision gives the user the opportunity to choose how many filter components they wish to insert.

The filter component may be any component that can be added to a smoking article filter. The filter component may alter at least one characteristic of the smoking experience. For example the filter component may act as a filter. In this case, the filter component may reduce the quantity of certain constituents of the mainstream smoke or vapour. The filter component in this case may comprise filtration material, for example cellulose acetate tow. The filter component may comprise activated carbon.

The filter component may alter the flow of the mainstream smoke or vapour through the filter. For example, the mainstream smoke or vapour may preferentially flow through the filter component or the filter component may act as a flow restrictor. The filter component in this case may have a higher or a lower resistance to draw than other components of the filter. The filter component may be substantially impermeable to the mainstream smoke or vapour.

The filter component may impart a flavour into the mainstream smoke or vapour. The filter component may be, for example, a flavour capsule; a flavour bead; or a flavour thread. Where the filter component is a flavour capsule, the flavour capsule may be a crushable flavour capsule, designed to be ruptured by the user compressing the smoking article filter with their fingers, lips or teeth.

The dispenser may be configured to dispense filter components of any shape. The filter component may have a circular cross sectional shape. For example, the filter component may be cylindrical or spherical. Preferably, the filter component is spherical.

The dispenser is configured to dispense filter components into the filter of smoking articles. The filter of the smoking articles may be configured to receive the filter components. The filter of the smoking articles may have a recess for receiving at least one filter component. The recess may be anywhere on the smoking article filter, but is preferably a mouth end recess. A particularly suitable smoking article for use with the dispenser of the invention comprises a mouthpiece comprising a first hollow tubular segment at the downstream end of the mouthpiece; and a second hollow tubular segment adjacent to and upstream of the first hollow tubular segment, the second hollow tubular segment defining a chamber for receiving a filter component. The first hollow tubular segment defines an opening through which a filter component can pass from the exterior of the mouthpiece into the chamber of the second hollow tubular segment. At least a portion of the first hollow tubular segment inwardly projects into the opening to retain the filter component in the chamber of the second hollow tubular segment.

The housing may be any shape. Preferably, the housing is generally cylindrical in shape. The exit orifice may be located at a planar end face of the cylindrical housing. The exit orifice may be shaped to allow any number of filter components to pass through it at a time. Preferably, the exit orifice is shaped to allow only one filter component to pass through it at a time.

As used herein, the terms "front" and "rear" refer to ends of the dispenser or components of the dispenser that are proximal and distal to the exit orifice respectively.

As used herein, the terms "forward" and "rearward" refer to directions from the rear end of the dispenser to the front end of the dispenser and from the front end of the dispenser to the rear end of the dispenser respectively.

Preferably, the dispenser further comprises a first storage zone disposed within the housing for storing a plurality of filter components, wherein the first storage zone is axially misaligned with the rod.

The provision of a first storage zone advantageously allows more than one filter component to be stored in the dispenser at any one time. The axial misalignment between the first storage zone and the rod allows the rod to be moved from the retracted position to the extended position without passing through the first storage zone. This means that the rod can move from the retracted position to the extended position without pushing more than a desired number of the filter components out of the dispenser, at any one time. This advantageously allows the dispenser to store multiple filter components whilst still enabling a single filter component to be dispensed at a time.

As used herein, the term "axially misaligned" is used to mean that the longitudinal axis of the rod is distinct from the longitudinal axis of the first storage zone. The result of this is that the rod and the first storage zone never occupy the same space.

The first storage zone may be configured to store a plurality of axially aligned filter components such that once the filter components are introduced into the first storage zone, their order cannot be changed. This may be advantageous if various different filter components are to be stored in the first storage zone and it is desirable to dispense them in a predetermined order.

The first storage zone may comprise an opening through which filter components stored therein may exit the first storage zone.

The first storage zone may be substantially straight. The longitudinal axis of the rod may be parallel to the longitudinal axis of the first storage portion. The longitudinal axis of the rod may not be parallel to the longitudinal axis of the first storage portion.

The first storage zone may be configured to accommodate any number of filter components. The first storage zone may accommodate between about 1 and about 30 filter components, preferably between about 5 and about 20 filter components, more preferably about 10 filter components.

The first storage zone may be at least partially defined by the inner surface of the housing. The first storage zone may be defined on a longitudinal edge by the inner surface of the housing.

The dispenser may further comprise a hard stop located at a front end of the first storage zone. The hard stop advantageously prevents filter components from exiting the first storage zone when the rod is in the extended position. The hard stop may be angled to encourage filter components to move towards the exit orifice when they exit the first storage zone. The hard stop may be a wall forming part of the inner surface of the housing. Preferably, the hard stop is integral with the housing.

Preferably, the dispenser further comprises a second storage zone disposed within the housing for storing a plurality of filter components, wherein the second storage zone is axially misaligned with the rod. The second storage zone is discrete from the first storage zone.

The provision of a second storage zone allows more filter components to be stored in the dispenser without the need to lengthen the first storage zone which could make the dispenser unacceptably long. The provision of a second storage zone may also advantageously allow different types of filter components to be stored separately in the dispenser. In this way, the user is able to use a single dispenser to dispense different types of filter components, at different times, depending on their preferences. For example, the first storage zone may contain a plurality of crushable capsules having a first flavour, and the second storage zone may contain a plurality of crushable capsules having a second flavour, that is different from the first flavour.

The second storage zone may be axially misaligned with the first storage zone. The second storage zone may be disposed next to the first storage zone. The second storage zone may be spaced apart from the first storage zone. The rod may be equidistant from both the first and the second storage zones. The rod may be disposed between the first storage zone and the second storage zone.

Preferably, the second storage zone is able to accommodate the same number of filter components as the first storage zone. The second storage zone may accommodate a different number of filter components as the first storage zone.

The second or any further storage zones may include any of the features described in relation to the first storage zone. In particular, the second storage zone may comprise a second hard stop and may be partially defined by an inner surface of the housing.

Preferably, the dispenser further comprises a carriage configured to advance filter components along the first storage zone towards the exit orifice.

The provision of a carriage ensures that there is always a filter component at the front end of the first storage zone ready to exit the first storage zone. This advantageously allows the dispenser to be used in any orientation without the need to rely on gravity to advance the filter components along the first storage zone.

As used herein, the term "advance" refers to a movement of a component of the dispenser or a filter component in the forward direction.

Preferably, the carriage, or a portion of the carriage, defines the rear end of the first storage zone. The carriage may advance the filter components by itself advancing along the dispenser and pushing the filter components towards the front of the first storage zone. The carriage may be formed from a single piece of material.

The carriage may also advance filter components along the second storage zone towards the exit orifice. The carriage, or a portion of the carriage, may also define the rear end of the second storage zone.

The carriage may comprise a central aperture. The rod may pass through the aperture.

Preferably, the carriage comprises a rod engagement mechanism configured to engage with at least one toothed section of the rod.

This advantageously allows the carriage to advance when the rod moves from the retracted position to the extended position, which in turn advances filter components along the first storage zone.

The rod engagement mechanism may be configured to engage with the at least one toothed section of the rod such that the carriage moves with the rod in some circumstances but not in others. For example, the rod engagement mechanism may be configured to engage with the at least one toothed section of the rod, and therefore advance with the rod unless there is an obstruction preventing the carriage from advancing. When there is such an obstruction, the rod engagement mechanism does not engage with the at least one toothed section of the rod and the rod may advance independently of the carriage, the carriage remaining stationary relative to the housing. The obstruction may be a filter component that is unable to advance any further along the first or the second storage zones. The at least one toothed section of the rod may be substantially straight. The at least one toothed section of the rod may be parallel to the longitudinal axis of the rod.

The at least one toothed section of the rod may comprise a series of alternating peaks and troughs. The peaks and troughs may be symmetrical.

As used herein, the term "symmetrical" is used to refer to peaks and troughs where each peak is equidistant from each of the two adjacent troughs. The peaks and troughs may be substantially triangular in shape. For example, each peak or trough may be the general shape of an isosceles triangle. The internal angle of the peaks may be any angle. Preferably, the angle should be greater than about 90 degrees. This advantageously ensures that the rod engagement mechanism is able to pass over the peaks when the rod engagement mechanism is not engaged with the at least one toothed section of the rod.

The rod engagement mechanism comprises at least one deflectable member configured to engage with the at least one toothed section of the rod. The tip of the deflectable member may be shaped to engage with the at least one toothed section of the rod. For example, the tip of the deflectable member may have a complimentary shape to the trough of the toothed section of the rod. This advantageously ensures efficient engagement between the rod engagement mechanism and the at least one toothed section of the rod.

When the rod engagement mechanism is engaged with the toothed section of the rod, the tip of the deflectable member sits in a trough of the toothed section of the rod allowing the carriage to advance as the rod is advanced.

When the rod engagement mechanism is not engaged with the toothed section of the rod, the deflectable member of the rod engagement element deflects allowing the tip of the deflectable member to pass over successive peaks and troughs of the toothed section of the rod whilst still remaining in contact with the toothed section of the rod. In this way, the rod is able to move independently of the carriage in either a forward or a rearward direction.

The rod may comprise any number of toothed sections. The rod may comprise for example, one, two, three, four, five or six toothed sections.

The rod engagement mechanism may comprise any number of deflectable members. Preferably, the rod engagement mechanism comprises a number of deflectable members that corresponds to the number of toothed sections of the rod such that each deflectable member is arranged to engage only one toothed section of the rod. The rod may comprise an even number of toothed sections. Where there are an even number of toothed sections, the toothed sections are preferably arranged in opposing pairs such that the deflectable members that engage them deflect in the same plane. This advantageously ensures that the force from each deflectable member is directly opposed by the force form another deflectable member thereby gripping the rod and ensuring effective engagement between the rod and the rod engagement mechanism.

Preferably, the carriage comprises a housing engagement mechanism configured to engage with at least one toothed section of the housing.

This advantageously prevents the carriage from moving rearwards when the rod moves rearwards from the extended position to the retracted position.

The housing engagement mechanism may be configured to engage with the housing when the rod moves rearwards but not to engage the housing when the rod moves forwards. The housing engagement mechanism may be configured to engage with at least one toothed section of the housing. The at least one toothed section of the housing may be substantially straight. The at least one toothed section of the housing may be parallel to the longitudinal axis of the rod.

The at least one toothed section of the housing may comprise a series of alternating peaks and troughs. The peaks and troughs may be asymmetrical.

As used herein, the term "asymmetrical" is used to refer to peaks and troughs where each peak is nearer to one of its adjacent troughs than it is to its other adjacent trough. Preferably, each peak is nearer the trough that is in front of it. The peaks and troughs may be substantially triangular in shape. For example, each peak or trough may be the general shape of a right angled triangle. Where each peak is the shape of a right angled triangle, the hypotenuse of each right angled triangle is on the rear side of the triangle.

The housing engagement mechanism comprises at least one deflectable member configured to engage with the at least one toothed section of the housing. The tip of the deflectable member may be shaped to engage with the at least one toothed section of the housing. For example, the tip of the deflectable member may have a complimentary shape to the troughs of the toothed section. This advantageously ensures efficient engagement between the housing engagement mechanism and the at least one toothed section of the housing.

When the carriage is urged rearwards, for example when the rod moves rearwards, the tip of the deflectable member of the housing engagement mechanism sits in a trough of the toothed section of the housing preventing the carriage from moving rearwards.

When the carriage is urged forwards, for example when the rod moves forwards, the tip of the deflectable member of the housing engagement element deflects allowing the tip of the deflectable member to pass over successive peaks and troughs of the toothed section of the housing whilst still remaining in contact with the toothed section of the housing. This allows the carriage to advance as the rod is advanced.

The housing may comprise any number of toothed sections. The housing may comprise for example, one, two, three, four, five or six toothed sections.

The housing engagement mechanism may comprise any number of deflectable members. Preferably, the housing engagement mechanism comprises a number of deflectable members that corresponds to the number of toothed sections of the housing such that each deflectable member is arranged to engage only one toothed section of the housing. The housing may comprise an even number of toothed sections. Where there are an even number of toothed sections, the toothed sections are preferably arranged in opposing pairs such that the deflectable members that engage them deflect in the same plane. This advantageously ensures that the force from each deflectable member is directly opposed by the force form another deflectable member thereby gripping the housing and ensuring effective engagement between the housing and the housing engagement mechanism.

The housing engagement mechanism may be disengaged by the user such that the carriage can be moved rearwards so that the dispenser can be refilled.

The first and second storage zones may each have a respective length in the longitudinal direction of the dispenser. Preferably the length of the first storage zone differs from the length of the second storage zone.

The difference in the length of the first and second storage zones advantageously ensures that only one filter component is dispensed at a time and further advantageously prevents multiple filter components entering the front portion of the dispenser at once which could lead to a blockage.

Preferably, the length of the first storage zone differs from the length of the second storage zone by a non-integer multiple of the length of a filter component. For example, where the filter components are 5 millimetres in length, the difference between the lengths of the first storage zone and the second storage zone should not be 5 millimetres, 10 millimetres, 15 millimetres or 20 millimetres etc. since all of these are multiples of 5. This ensures that, as the carriage advances, the furthest forward filter component in one storage zone will be further forward than the furthest forward filter component in the other storage zone. This advantageously ensures that only one filter component exits either storage zone at a time.

The non-integer multiple of the length of a filter component may preferably be expressed as 1/n where n is the total number of distinct storage zones in the dispenser. For example, where there are only two distinct storage zones, the length of the first storage zone differs from the length of the second storage zone by half the diameter of a single filter component. Where there are three distinct storage zones, the first storage zone is longer than the second storage zone by a third of the diameter of a single filter component, and the second storage zone is longer than the third storage zone by a third of the diameter of a single filter component.

This advantageously ensures that the user is able to actuate the dispenser in a consistent manner irrespective of from which storage zone the next filter component will be released. Furthermore, this configuration advantageously allows different types of filter components to be stored separately in the dispenser. In this way, the user is able to use a single dispenser to dispense different types of filter components, at different times, depending on their preferences. For example, each storage zone may contain a plurality of crushable capsules having a flavour that is different from the flavour of the capsules in each of the other storage zones.

The longer storage zone may extend further forwards than the shorter storage zone. The longer storage zone may extend further rearwards than the shorter storage zone.

Preferably, the carriage comprises a first face defining a rear end of the first storage zone, and a second face defining a rear end of the second storage zone, wherein the first face of the carriage is longitudinally off-set from the second face of the carriage.

In this embodiment of the invention, the difference in the length between the first storage zone and the second storage zone is accounted for by the first and second faces defining the rear ends of the first and second storage zones respectively being longitudinally offset relative to one another. This results in the longer storage zone extending further rearwards than the shorter storage zone.

The size of the offset between the first and second faces may be a non-integer multiple of the length of a filter component. The non-integer multiple of the length of a filter component may preferably be expressed as 1/n where n is the total number of distinct storage zones in the dispenser.

Preferably, the dispenser further comprises a loading zone for accommodating a single filter component when the rod is in the retracted position, the loading zone being disposed between the exit orifice and the first end face of the rod when the rod is in the retracted position.

The loading zone is configured to receive filter components from all of the storage zones. In operation the loading zone may receive filter components from each of the storage zones in turn.

The filter component enters the loading zone from a storage zone as the rod moves from the extended to the retracted position.

The loading zone is in communication with each of the storage zones.

Preferably, at least a portion of the front end of the rod extends towards the first storage zone.

The provision of having a portion of the front end of the rod extending towards the first storage zone ensures that only one filter component at a time is able to pass into the loading zone. The portion of the front end of the rod extending towards the first storage zone prevents filter components from exiting the storage zone regardless of the orientation of the dispenser.

The portion of the front end of the rod extending towards the first storage zone is configured to allow filter components to exit the storage zone when they are subject to a minimum force, for example when the filter components are pushed by the filter component behind them or by a face of the carriage.

The portion of the front end of the rod extending towards the first storage zone may deflect as it passes the furthest forward filter component in the first storage zone as the rod moves from a fully extended position to a fully retracted position. This is preferable where the filter components are hard and undeformable or otherwise where they are delicate and would likely be damaged if they were deformed.

Alternatively, or in addition, the furthest forward filter component in the first storage zone may be compressed by the portion of the front end of the rod extending towards the first storage zone as the rod moves from a fully extended position to a fully retracted position. This is preferable where the filter components are resiliently deformable. The portion of the front end of the rod extending towards the first storage zone may partially occlude an opening in the storage zone. The portion of the front end of the rod extending towards the first storage zone may be any shape. The front portion of the rod may be angled towards the first storage zone. The front portion of the rod may include one or more protrusions that extend towards the rod. The rod may increase in diameter at its front end. The distance between the front end portion of the rod and the adjacent portion of the housing may be less than the diameter of a filter component. The distance between the front end portion of the rod and the adjacent portion of the housing may be selected to allow first end portion of the rod to pass the filter components without damaging the filter components. In embodiments of the invention comprising more than one storage zone, the front end of the rod may extend towards each of the storage zones.

Alternatively, or in addition to the portion of the front end of the rod extending towards the first storage zone, the dispenser may comprise a first storage zone restricting element. The first storage zone restricting element advantageously ensures that only one filter component at a time is able to pass into the loading zone. The first storage zone restricting element may comprise a protrusion on the inner surface of the housing. In this case, the distance between the first protrusion and the portion of the rod adjacent the protrusion is less than the diameter of a filter component. The distance between the protrusion and the portion of the rod adjacent the protrusion is selected to allow filter components to be pushed past the front end portion of the rod without the filter components being damaged.

In such embodiments, the dispenser may further comprise a first pre-loading zone disposed between the first protrusion and the front end of the first storage zone. The pre-loading zone may be sized to accommodate a single filter component when the rod is in the extended position. The pre-loading zone may be defined on its longitudinal sides by the rod and the housing.

The provision of a pre-loading zone further ensures that only one capsule at a time passes from the first storage zone to the loading zone.

In embodiments of the invention comprising more than one storage zone, the dispenser may comprise more than one restricting element and pre-loading zone. There may be one restricting element and one pre-loading zone per storage zone.

Preferably, the exit orifice comprises an exit orifice restricting element for restricting the exit of filter components from the dispenser.

The exit orifice restricting element retains filter components in the loading zone unless they are pushed by the rod, in which case the filter component is able to pass the restricting element and exit the exit orifice. The exit orifice restricting element may partially occlude the exit orifice.

The exit orifice restricting element preferably comprises a rigid element. This is particularly appropriate where the filter components are resiliently deformable such that they can be compressed as they pass through the exit orifice. The use of a rigid element is advantageous since it is likely to be more durable than a non-rigid element. This may advantageously extend the life of the dispenser enabling it to be used repeatedly.

Preferably, the exit orifice restricting element comprises a resiliently deformable element. This is preferable where the filter components are hard and undeformable or otherwise where they are delicate and would likely be damaged if they were deformed. For example, the exit orifice restricting element may be a protrusion from the circumference of the exit orifice.

The exit orifice restriction may arise from the fact that the width of the exit orifice is smaller than the diameter of the filter component. In this case, the height of the exit orifice is greater than the diameter of the filter component to allow the filter component to fit through the exit orifice. For example, where the filter components are spherical, the exit orifice may have an oval shape. Alternatively or additionally, the dispenser may include at least one protrusion that extends into the exit orifice to form the exit orifice restricting element. This may be used if the exit orifice would otherwise be substantially oval in shape, but is particularly advantageous if the exit orifice would otherwise be substantially circular in shape. The protruding element may be disposed on an inner surface of the loading zone.

As used herein, the terms "width" and "height" refer to the minor and the perpendicular major axes of the exit orifice, with the width being the minor axis and the height being the major axis. For example, if the exit orifice has a substantially oval cross sectional shape, then the width forms the narrowest part of the exit orifice and the height forms the widest part of the exit orifice.

The exit orifice restricting element may be attached to the housing of the dispenser. The exit orifice restricting element may be integrally formed with the housing of the dispenser.

Preferably, the first storage zone is at least partially defined by a surface portion of the rod.

Since the rod and the first storage zones are axially misaligned, the rod is able to define a longitudinal side of the first storage zone. This advantageously removes the need to include separate portions of material for defining this side of the first storage portion.

The first storage zone is defined on its longitudinal sides by the surface portion of the rod and the housing, at its rear end by the first face of the carriage, and at its front end by the restricting element.

The surface portion of the rod may be configured to enable filter components to run along it efficiently. The surface portion of the rod may be shaped to generally conform to the shape of the filter components. This advantageously keeps the filter components aligned within the first storage zone and ensures that the operation of the dispenser is consistent.

Where the dispenser comprises multiple storage zones, different surface portions of the rod may at least partially define each storage zone.

Preferably, the surface portion of the rod adjacent the first storage zone generally has an arc shaped surface cross section.

An arc shaped cross section advantageously conforms to the general shape of the filter components when the filter components are spherical.

The radius of the arc shaped cross section is preferably approximately the same as the radius of the spherical filter components.

Where the dispenser comprises multiple storage zones, different surface portions of the rod may have cross sections that generally conform to the shape of the filter components. In particular, where all of the filter components are spherical, all of the different surface portions of the rod may generally have arc shaped surface cross sections.

If filter components of different sizes or shapes are to be stored in different storage zones then the surface portion of the rod adjacent each storage zone may have a different cross sectional shape.

Preferably. the dispenser further comprises a spring configured to urge the rod towards the retracted position.

The spring is configured to move the rod from the extended position to the retracted position once a filter component has been dispensed.

The spring may be any type of spring. For example the spring may be a tension spring, a compression spring or a torsion spring. Preferably the spring is a helical compression spring.

The spring may act between a portion of the housing a portion of the rod. The spring may be attached at one end to a portion of the housing and at another end to a portion of the rod. Where the spring is a compression spring, the spring acts on a portion of the housing at the front end of the spring and on a portion of the rod at the rear end of the spring. The spring may act on an annular projection on the inner surface of the housing and on an annular projection on the rod. Rod may pass through the centre of the spring. There may be more than one spring. Where there is more than one spring, the springs may be disposed either side of the rod.

Preferably, the dispenser further comprises a receiving section for receiving an end of a smoking article and aligning said end with the exit orifice.

The receiving section is used by the consumer to conveniently align the buccal end recess of the filter of the smoking article with the exit orifice.

The receiving section may temporarily retain at least a portion of the filter of a smoking article meaning it does not need to be held by the user. The receiving section may be integrally formed with the housing. The receiving section may be removably attached to the housing allowing the user to change the receiving section depending on the diameter of the smoking article filter being used.

The receiving section may comprise an open ended tube in axial alignment with the exit orifice. The interior walls of the receiving section may be substantially parallel. The interior walls of the receiving section may be angled such that the inner diameter of the receiving section is smaller at the end nearest the exit orifice.

The dispenser may comprise a button to advance the rod from a retracted position to an extended position. The button may be activated by the user when they wish to dispense a filter component from the dispenser.

The button may be located at a position that makes it convenient for the user to both hold the dispenser and actuate the button with one hand. The button may be located on the side of the container. The button may be located at the rear end of the dispenser. The button may be axially aligned with the rod. This advantageously simplifies the construction of the dispenser and endures the rod is loaded evenly when the button is actuated. This will also make the dispenser more intuitive to use.

The button may be a distinct component from the rod. In this case, the button may be attached to the rod. The button may be permanently attached to the rod. The button may be removably attached to the rod. The provision of the button being removably attached to the rod may enable the user to refill the first storage zone, or any other storage zones, with filter components. The button may be integrally formed with the rod. The button may be have a smaller diameter than the internal diameter of the housing such that the button may be at least partially circumscribed by the housing.

The button may have a larger diameter than the rod. Where this is the case, the button may comprise at least one rearwardly extending recess on the front surface of the button. The at least one rearwardly extending recess may partially accommodate the spring configured to move the rod from the extended position to the retracted position once a filter component has been dispensed.

The dispenser may further include at least one stop to limit the forward movement of the rod in the axial direction. It may be unnecessary or even undesirable for the rod to move forward beyond predetermined position. Accordingly, a stop may prevent the rod from moving forward beyond this position. The stop may be a projection on the inner surface of the housing that that engages with a corresponding projection of the rod when the rod has reached the furthest forward position. The button may have an annular projection at its rear end, the diameter of which is larger than the internal diameter of the housing such that annular projection cannot pass into the housing as the button is depressed. This may act as the stop.

The positions of the portions of the rod and the housing on which the spring acts may be configured such that they may also act as the stop to limit the forward movement of the rod.

The dispenser may further comprise at least one stop to limit the rearward movement of the rod in the axial direction. It may be unnecessary or even undesirable for the rod to move rearward beyond predetermined position. For example, if the front face of the rod moves too far rearwards, then more than one filter component stored within the storage zones may move into the loading zone. This may lead to the dispenser failing to operate.

The dispenser may further comprise at least one rod support. The at least one rod support helps to guide the rod as it moved between the fully extended position and the fully retracted position. The at least one rod support may also prevent the rod from bending. The at least one support may be disposed at a front end portion of the dispenser. The at least one support may be attached to the inner surface of the housing. The at least one support may be integrally formed with the housing. There may be more than one support in some embodiments, the supports may be spaced apart to provide support for the rod at different points within the dispenser. The most rearward rod support may also act as a stop to limit the forward movement of the rod in the axial direction. The spring may also act on the most rearward rod support.

In a second aspect of the invention, there is provided a kit of parts comprising a dispenser and a smoking article. The smoking article comprises a filter section having a mouth end recess wherein the recess in configured to retain at least one filter component.

The provision of a kit of parts advantageously allows consumers to conveniently customise their smoking experience without the need to purchase several different types of smoking article. For example, if the filter component is a flavour capsule, the kit of parts can allow a consumer to choose a specific flavour capsule that they wish to use with a specific smoking article depending on the desired customised experience they wish to obtain.

The kit of parts may further comprise a set of instructions that describe how the dispenser and the smoking article should be used together in order to insert a filter unit into the mouth end recess of a filter section of the smoking article.

In use, a dispenser according to the invention can be operated as described below. The description is of the operation of a dispenser comprising a first storage zone and a second storage zone. However, it will be appreciated that much of the described operation is equally applicable to the operation of a dispenser according the invention comprising fewer or more storage zones.

The first face of carriage, which defines the rear end of the first storage zone, is set further forward on the carriage then the second face of the carriage, which defines the rear end of the first storage zone. The offset between the first face of the carriage and the second face of the carriage is half the diameter of a single filter component.

Considering the movement of the rod, the operation of the dispenser comprises an extending phase, where the rod moves from the fully retracted position to the fully extended position, and a retracting phase, where the rod moves from the fully extended position to the fully retracted position.

Beginning with the extending phase, when the rod is in the fully retracted position, the first end face of the rod is fully disposed within the housing and is spaced away from the exit orifice to form a loading zone therebetween. In the fully retracted position, there is a single filter component disposed within the loading zone. There are the same number of filter components in both the first storage zone and the second storage zone.

Firstly, the user aligns the exit orifice of the dispenser with the buccal end filter recess of a smoking article. This is done with the help of the receiving section.

The extending phase comprises two stages. The first of these may be defined as the stage in which the rod and the carriage advance together. The second of these may be defined as the stage in which the rod advances independently of the carriage.

In the first stage of the extending phase, the user depresses the button, causing the rod to advance towards the exit orifice. At the same time, the rod engagement mechanism of the carriage engages with the toothed sections of the rod. This causes the carriage to advance towards the exit orifice at the same rate as the rod.

As the carriage advances, the first and second faces of the carriage push the aligned row of filter components in their respective storage zones towards the first and second hard stops respectively. Since the first face of the carriage is disposed further forwards than the second face of the carriage and there are the same number of filter components in each storage zone, the filter components in the first storage portion will be compressed between the first face of the carriage and the first hard before the filter components in the second storage zone are compressed between the second face of the carriage and the second hard stop. At this point, the carriage is unable to advance any further since the first face of the carriage, the filter components in the first storage zone and the first hard stop are in contact meaning there is no space into which the carriage can advance. Since the second face of the carriage is disposed further rearwards than the first face of the carriage and there are the same number of filter components in each storage zone, at this point, there is still empty space in the second storage zone.

In the second stage of the extending phase, the carriage is unable to advance any further but the button is still being pressed. At this point, the rod engagement mechanism of the carriage is disengaged from the rod and the rod is able to continue to advance, independent of the carriage.

As the rod advances, the first end face of the rod engages with the filter component disposed in the loading zone and begins to push the filter component towards the exit orifice. Once the filter component reaches the exit orifice, the first face of the rod pushes the filter component past the exit orifice restricting element and through the exit orifice. The first end face of the rod passes through the exit orifice behind the filter component and continues to push the filter component. The rod pushes the filter component through the narrow mouth end portion of a recess of a smoking article.

Eventually, the rod reaches its fully extended position and is prevented from advancing further by a stop which limits the forward movement of the rod. At this point, the user releases the button and the retracting phase begins.

Once the user has released the button, the spring begins to move the rod from the fully extended position to the fully retracted position. As the rod moves rearwards, the housing engagement mechanism of the carriage engages with the at least one toothed section of the housing. This prevents the carriage moving rearwards with the rod. The rod therefore moves rearwards independently of the carriage.

As the rod moves rearwards, the first end face of the rod passes back through the exit orifice and continues to move rearwards to form the loading zone between the first face of the rod and the exit orifice. As the rod does this, the portion of the front end of the rod that extends towards the second storage zone urges the row of aligned filter components in the second storage zone rearwards. The portion of the front end of the rod that extends into the first storage zone also engages with the row of aligned filter components in the first storage zone. However, since the first end face of the carriage is set further forwards than the second end face of the carriage, there is no space into which the filter components may move. As a result, the first end face of the rod moves rearwards past the first storage zone while the filter components remain in place. The furthest forward filter component in the first storage zone is compressed as the first end of the rod passes it.

Once the first end of the rod passes the furthest forward filter component in the first storage zone, the furthest forward filter component in the first storage zone is guided by the first hard stop into the loading zone.

The rod continues to move rearward until it reaches the fully retracted position determined by a stop to limit the rearward movement of the rod. The dispenser may be stored in this condition until the user wishes to use it again.

The next time the button is pressed, the operation is very similar to the operation described above. However, since there is now one more filter component in the second storage zone compared to the first storage zone, the aligned row of filter components in the second storage zone becomes compressed between the second face of the carriage and the second hard stop before the filter components in the first storage portion are compressed between the first face of the carriage and the first hard stop. The carriage is then prevented from advancing any further but the rod continues to advance as described above.

Once the rod has pushed the filter component disposed in the loading zone out of the exit orifice and the button is released, the rod begins to move from the fully extended position to the fully retracted position, as described above. This time, it will be the furthest forward filter component in the second storage zone that will be compressed by the first portion of the rod as it moves from the fully extended position to the fully retracted position. Accordingly, it will be this filter component that will eventually pass into the loading zone as the first end of the rod passes. The rod will continue to move rearwards until it reaches the fully retracted position.

Since there is now the same number of filter components in both storage zones again but the first face of the carriage is disposed further forwards than the second face of the carriage, the next time the button is pressed, the furthest forward filter component in the first storage zone will advance to the loading zone. In this way, the dispenser will alternate from which storage zone the next filter component to be dispensed comes.

The invention will now be further described, by way of example only, with reference to the accompanying drawings in which.

Figure 1:
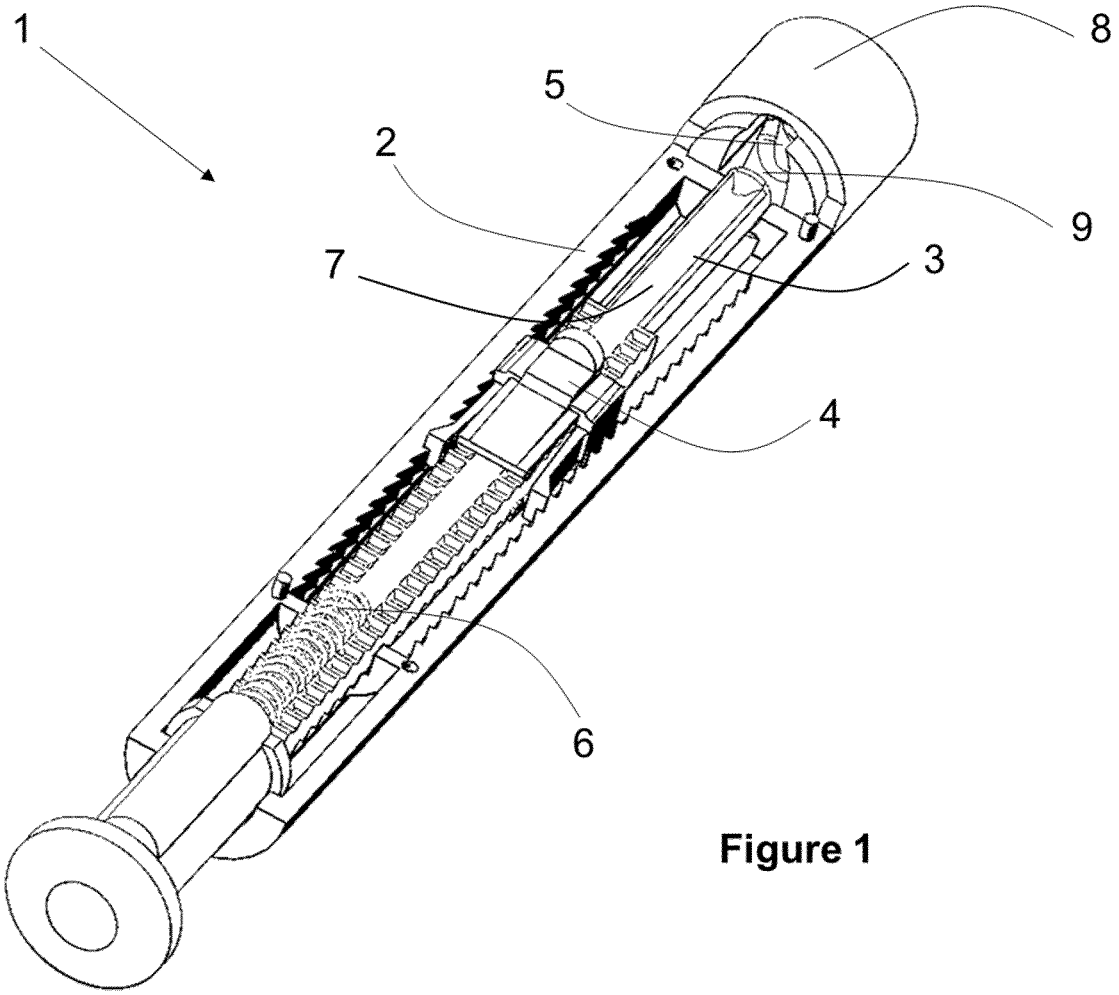
FIG. 1 shows a dispenser in accordance with the present invention with a portion of the housing removed.

FIG. 1 shows a dispenser 1 according to an embodiment of the present invention wherein one half of a two part housing is removed to expose the internal features. The dispenser 1 is configured for dispensing spherical filter components (not shown), such as flavour capsules, into recessed filters of smoking articles. The dispenser 1 comprises a housing 2. The housing 2 is formed from two halves, each of which runs the full length of the housing. In FIG. 1, only one half of the housing 2 is shown.

Figure 2:
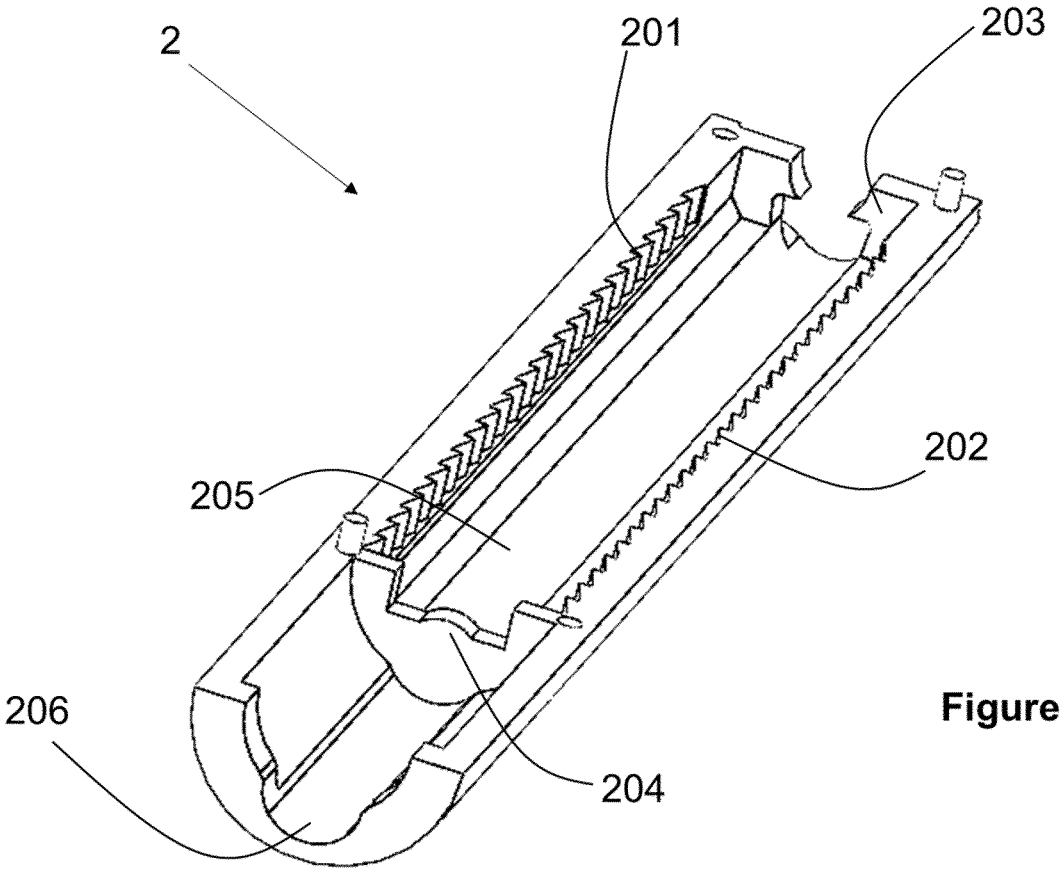
FIG. 2 shows a portion of the housing of the dispenser of FIG. 1.

FIG. 2 shows a more detailed view of one half of the two part housing 2. The half comprises a first toothed section 201 and a second toothed section 202 disposed on opposing sides on the inside surface of the housing 2. The first 201 and second 202 housing toothed sections comprise a series of peaks and troughs. The peaks and troughs are not symmetrical meaning that each peak is nearer the trough immediately in front of it than the trough immediately behind it. This results in each peak having the shape of a right angled triangle. The housing 2 comprises a forward rod support element 203 and a rear rod support element 204. The rear rod support element 204 also acts as a stop to limit the forward movement of the rod in the axial direction. The front end of the spring 6 acts on the rear rod support element 204. The rear of the housing 2 includes an aperture, the size and shape of which corresponds to the portion of the rod 3 that passes therethrough. A portion 205 of the interior surface of the housing 2 has a substantially arc shaped cross-section, this substantially corresponds to the shape of the filter components. This portion 205 of the interior surface of the housing 2 defines a longitudinal side of the first storage zone 7. It is understood that the second half of the housing 2 (not shown) is substantially the same as the first half of the housing 2 shown in FIG. 2.

The housing contains a rod 3, a carriage 4 and a spring 6. Within the housing 2 is a first storage zone 7 for storing a plurality of filter components in axial alignment, and a second storage zone (not shown) for storing a plurality of filter components in axial alignment.

The dispenser 1 further comprises a loading zone 9 disposed between a first end of the rod and the exit orifice 5. The loading zone is sized to accommodate a single filter component.

The dispenser 1 comprises an exit orifice 5 at the front end of the dispenser. The dispenser 1 comprises a receiving section 8 for receiving an end of a smoking article and aligning said end with the exit orifice 5. The receiving section comprises an open ended tube that extends forward of the exit orifice 5 having an inner diameter similar to that of a smoking article.

Figure 3:
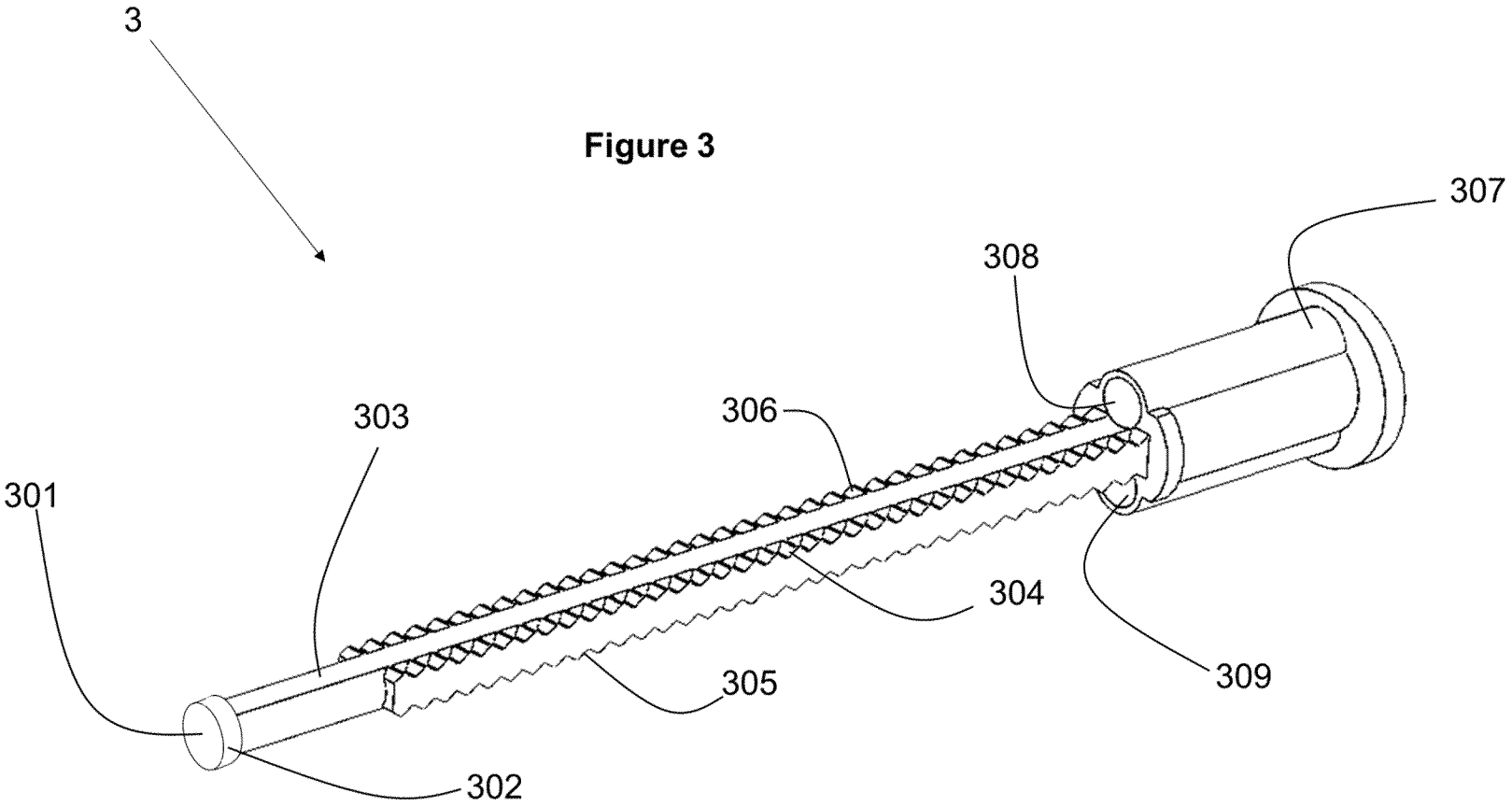
FIG. 3 shows the rod of the dispenser of FIG. 1.

FIG. 3 shows a more detailed view of the rod 3. The rod 3 comprises a first end face 301 at a front end of the rod. The rod 3 includes an annular protrusion 302 immediately rearward of the first end face 301 of the rod. A first surface 303 of the rod 3 has a substantially arc shaped cross section. This corresponds the shape of the filter components and defines a longitudinal surface of the first storage zone 7. A second surface (not shown) of the rod 3 directly opposes the first surface 303 and also has a substantially arc shaped cross section. This corresponds the shape of the filter components and defines a longitudinal surface of the second storage zone.

The rod comprises a first 304, a second 305, a third 306 and a forth (not visible) toothed sections. The toothed sections are arranged on either side of the first 303 and second surfaces of the rod in opposing pairs. The first 304 and second 305 toothed sections are on a first side of the first 303 and second surfaces of the rod and oppose one another. The third 306 and forth toothed sections are on a second side of the first 303 and second surfaces of the rod and oppose one another. Each of the toothed sections comprises a series of alternating peaks and troughs. The peaks and troughs are symmetrical such that the distance from a peak to the trough immediately preceding it is the same as the distance from the peak to the trough immediately succeeding it. Each peak has the shape of an isosceles triangle.

The rod further comprises a button 307 at the rear end of the rod. The button 307 comprises an annular protrusion at its rear end. The button includes two forward facing recesses 308 and 309 for receiving the rear ends of two springs, one of which is spring 6.

Figure 4:
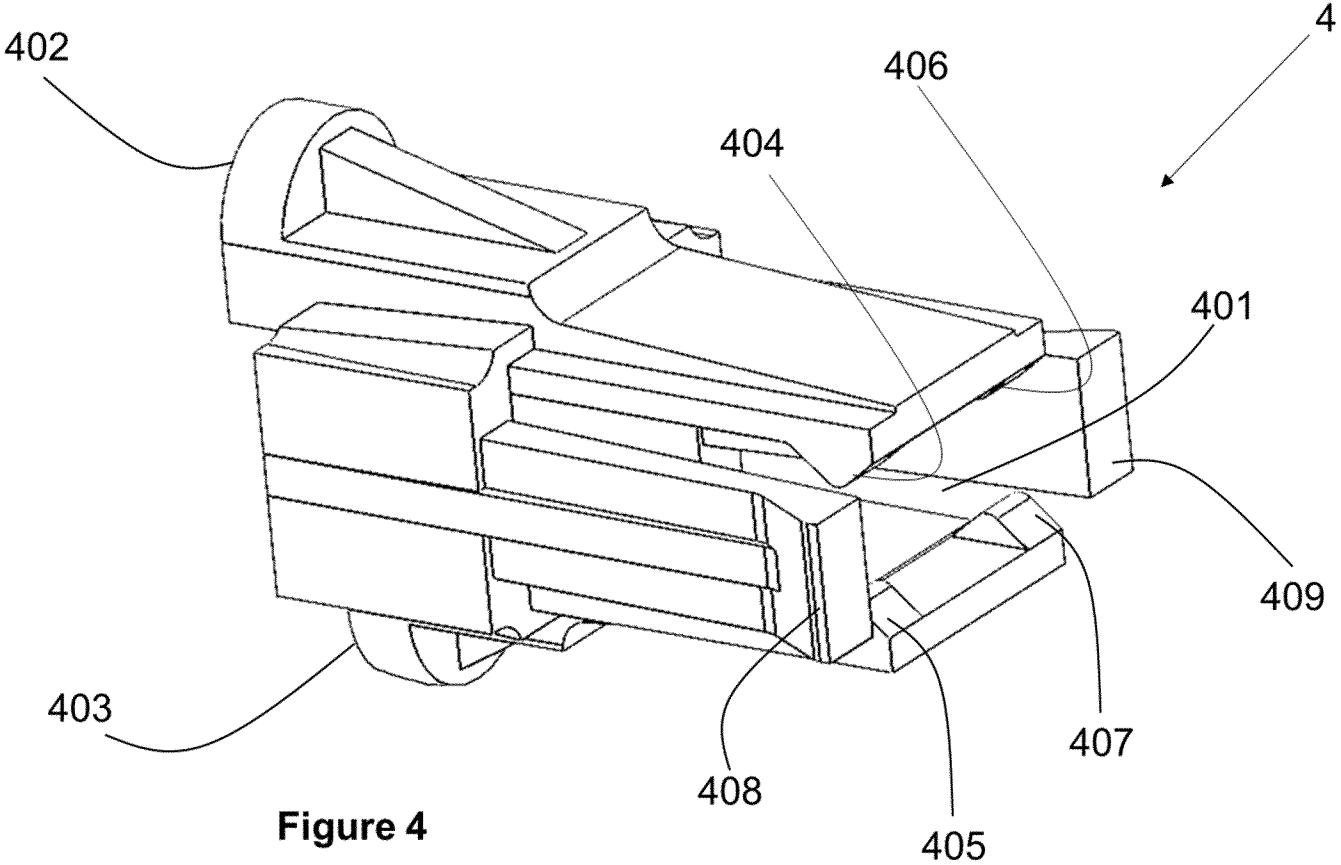
FIG. 4 shows the carriage of the dispenser of FIG. 1.

FIG. 4 shows a more detailed view of the carriage 4. The carriage 4 comprises a central aperture 401 sized to allow a portion of the rod to pass therethrough. The carriage 4 comprises a rod engagement mechanism comprising a first 404, second 405, third 406 and forth 407 resilient member. The resilient members are arranged in two opposing pairs on either side of the central aperture 401. The first resilient member 404 opposes the second resilient member 405 and the third resilient member 406 opposes the forth resilient member 407. The tips of the resilient members 404, 405, 406, and 407 are prismatic in shape and substantially correspond to the shape of the troughs in the toothed sections of the rod 304, 305 and 306. The first 404, second 405, third 406 and fourth 407 resilient members of the carriage engage with the first 304, second 305, third 306 and fourth toothed sections of the rod respectively.

The carriage further comprises a housing retaining means comprising a first 408 and a second 409 resilient member. The resilient members 408 and 409 are arranged on opposing sides of the central aperture 401. The tips of the resilient members 408 and 409 are generally prismatic in shape and substantially correspond to the shape of the troughs in the toothed sections of the housing 201 and 202.

The carriage further comprises a first end face 402 and a second end face 403 which define the rear end of the first 7 and second storage zones respectively. The first end face 402 is set further forwards than the second end face 403. The distance in the longitudinal direction between the first 402 and the second 403 end faces is half the diameter of a single filter component.

Figure 5:
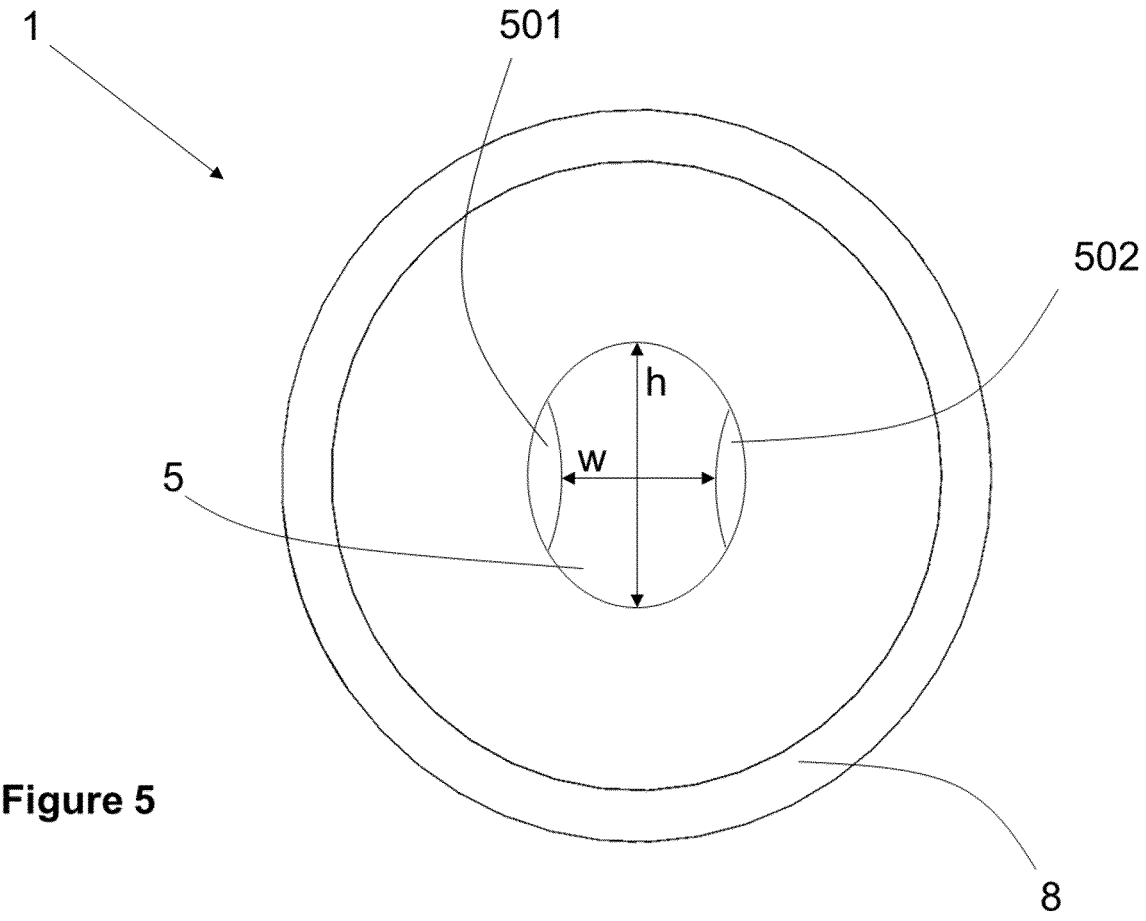
FIG. 5 shows an end-view of the dispenser of FIG. 1.

FIG. 5 shows the dispenser 1 when viewed from the front end. The exit orifice 5 can be seen in the centre. The exit orifice 5 has a substantially oval shape that is partially delimited by two protrusions 501 and 502 on the inner surface of the housing. The distance w between the protrusions is less than the diameter of a filter component to prevent filter components unintentionally falling out of the exit orifice 5. The distance h between ends of the exit orifice in a perpendicular direction to distance w is greater than the diameter of a filter component. The protrusions 501 and 502 are rigid elements and are integrally formed with the housing.

FIG. 5 also shows the receiving section 8 for receiving an end of a smoking article and aligning said end with the exit orifice 5.

FIGS. 6A to 6I shows a representation of the some of the components of a dispenser 1 in accordance with the present invention, at various stages during the operation of the dispenser 1. FIGS. 6A to 6I show representations of a portion of the dispenser 1 in which the housing 3 contains the rod 2 and the carriage 4. The dispenser 1 comprises a first 7 and second 607 storage zone and a loading zone 9 disposed between the first end face of the rod 2 and the exit orifice 5. The dispenser 1 further comprises a first 604 and second 605 hard stop forward of the first 7 and second 607 storage zones respectively. Arrow 602 represents the direction of the movement of the rod 2 at various stages of the operation of the dispenser 1. Arrow 603 represents the direction of the movement of the carriage 2 at various stages of the operation of the dispenser 1. Dashed line 608 indicates the longitudinal position of the first face of the carriage at each stage of the operation of the dispenser 1.

Figures 6A, 6B, 6C, 6D:
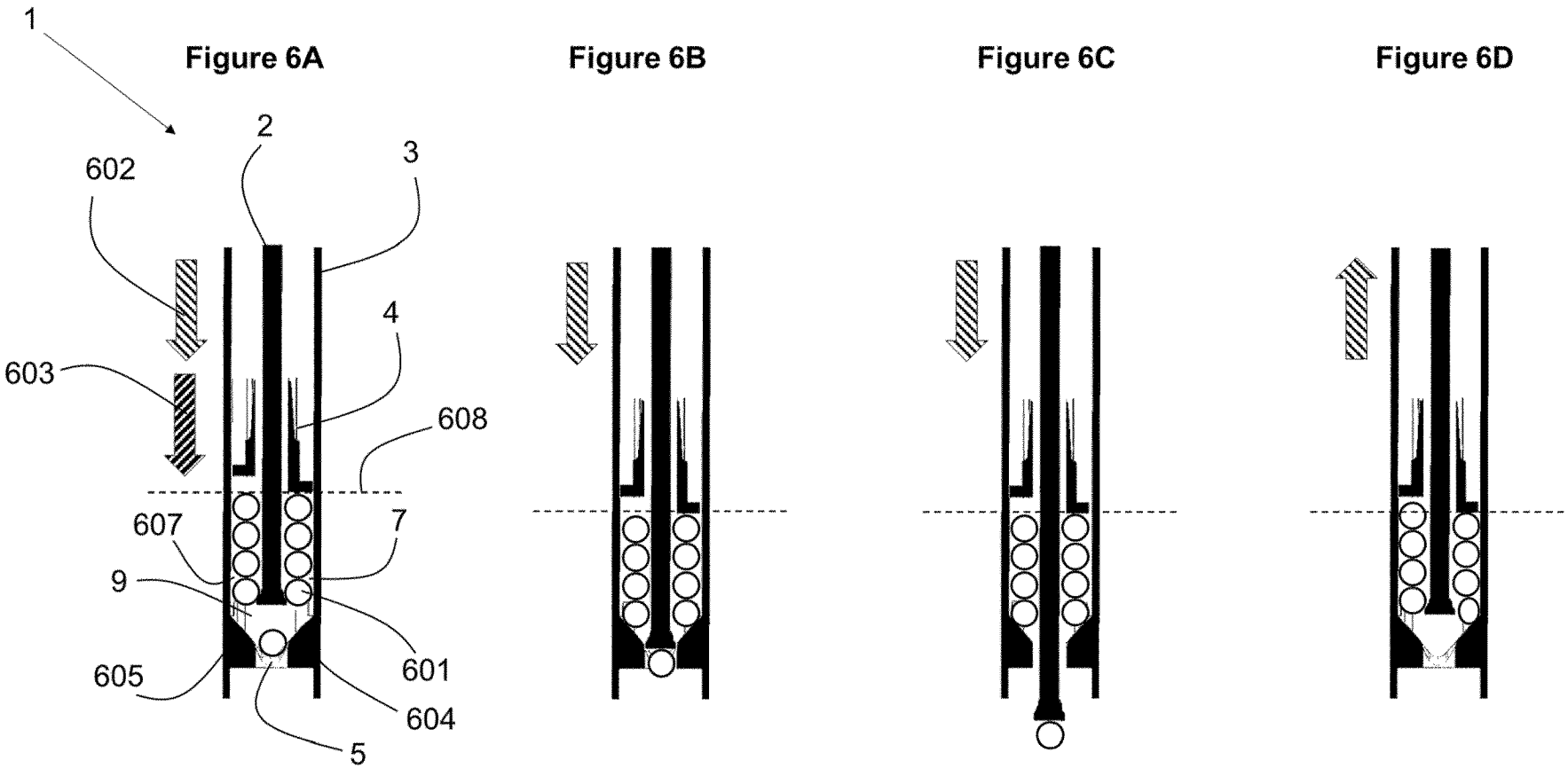
FIGS. 6A to 6I show the operation of a dispenser in accordance with the present invention.

In FIG. 6A, each storage zone 7 and 607 contains 4 axially aligned filter components 601 and the loading zone 9 contains a single filter component 601. At the stage shown in FIG. 6A, the button (not shown) has started to be depressed and the rod 2 has begun to advance towards the exit orifice 5. At this stage, the rod engagement mechanism of the carriage 3 engages with the toothed sections of the rod 2. As a result, the carriage 3 also advances towards the exit orifice. As it advances, the cartridge pushes the rows of axially aligned filter components 601 in both the first and second storage zones 7 and 607 towards the exit orifice 5.

In FIG. 6B, the carriage is no longer able to advance as the filter components in the first storage zone are pushed against the first hard stop 604 by the first end face of the carriage 4. At this point, the rod engagement mechanism disengages and the rod 2 continues to advance independently of the carriage 4 and pushes the filter component 601 disposed in the loading zone 9 towards the exit orifice 5.

In FIG. 6C, the rod 2 has pushed the filter component 601 through the exit orifice 5. The first end face of the rod 2 has passed though the exit orifice and continues to push the filter component 601 until the rod reaches the fully extended position.

In FIG. 6D, the button (not shown) has been released and the spring (not shows) has begun to move the rod 2 rearwards from the fully extended position to the fully retracted position. The housing engagement mechanism of the carriage prevents the carriage 4 moving rearwards with the rod 2. As the first end face of the rod passes the first 601 and second 607 storage zones, the protrusions at the first end of the rod 2 push the row of alighted filter components in the second storage zone 607 rearwards towards the second end face of the carriage 4. The protrusions at the first end of the rod 2 also act on the row of aligned filter components in the first storage zone 7, however, since the first end face of the carriage 4 is set further forwards than the second end face of the carriage 4, there is no space into which the filter components 601 may move. As a result, the first end face of the rod 2 moves rearwards past the first storage zone 7 while the filter components remain in place. The furthest forward filter component 601 in the first storage zone 7 is compressed as the protrusions at the first end of the rod 2 pass it.

Figures 6E, 6F, 6G, 6H, 6I:
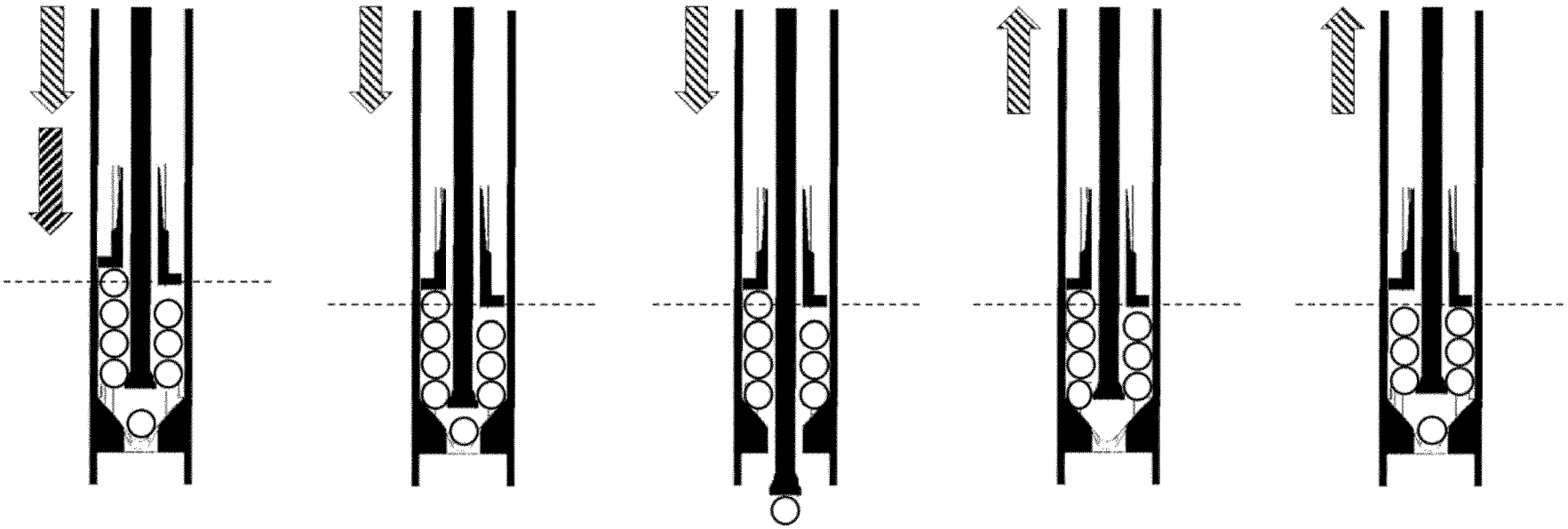

In FIG. 6E, the rod has moved further rearwards than in FIG. 6D. As a result, the aligned row of filter components in the second storage zone has moved further rearwards. The filter component that was compressed as protrusions at the first end of the rod 2 passed it has now moved from the first storage zone 7 into the loading zone 9. The rod continues to move further rearwards until it reaches its most retracted position. There are now four axially aligned filter components in the second storage zone 607, three axially aligned filter components in the first storage zone 7 and one filter component in the loading zone 9.

Once in the fully retracted position, the process can begin again as the button (not shown) is depressed and the rod 6 begins to advance towards the exit orifice 5. At this stage, the rod engagement mechanism of the carriage 3 engages with the toothed sections of the rod 2. As a result, the carriage 3 also advances towards the exit orifice. As it advances, the cartridge pushes the rows of axially aligned filter components 601 in both the first and second storage zones 7 and 607 towards the exit orifice 5.

In FIG. 6F, the carriage is no longer able to advance as the filter components in the second storage zone are pushed against the second hard stop 605 by the second end face of the carriage 4. At this point, the rod engagement mechanism disengages and the rod 2 continues to advance independently of the carriage 4 and pushes the filter component 601 disposed in the loading zone 9 towards the exit orifice 5.

In FIG. 6G, the rod 2 has pushed the filter component 601 through the exit orifice 5. The first end face of the rod 2 has passed though the exit orifice and continues to push the filter component 601 until the rod reaches the fully extended position.

In FIG. 6H, the button (not shown) has been released and the spring (not shown) has begun to move the rod 2 rearwards from the fully extended position to the fully retracted position. The housing engagement mechanism of the carriage prevents the carriage 4 moving rearwards with the rod 2. As the first end face of the rod passes the first 7 and second 607 storage zones, the protrusions at the first end of the rod 2 push the row of alighted filter components in the first storage zone 7 rearwards towards the first end face of the carriage 4. The protrusions at the first end of the rod 2 also act on the row of aligned filter components in the second storage zone 7, however, since there is one more filter component 601 in the second storage zone 607 than in the first storage zone 7, there is no space into which the filter components 601 may move. As a result, the first end face of the rod 2 moves rearwards past the second storage zone 607 while the filter components remain in place. The furthest forward filter component 601 in the second storage zone 607 is compressed as the protrusions at the first end of the rod 2 pass it.

In FIG. 6I, the rod has moved further rearwards than in FIG. 6H. As a result, the aligned row of filter components in the first storage zone has moved further rearwards. The filter component that was compressed as protrusions at the first end of the rod 2 passed it has now moved from the second storage zone 607 into the loading zone 9. The rod continues to move further rearwards until it reaches its most retracted position. There are now three axially aligned filter components in both the first 7 and second storage zone 607 and one filter component in the loading zone 9.

Figure 7A:
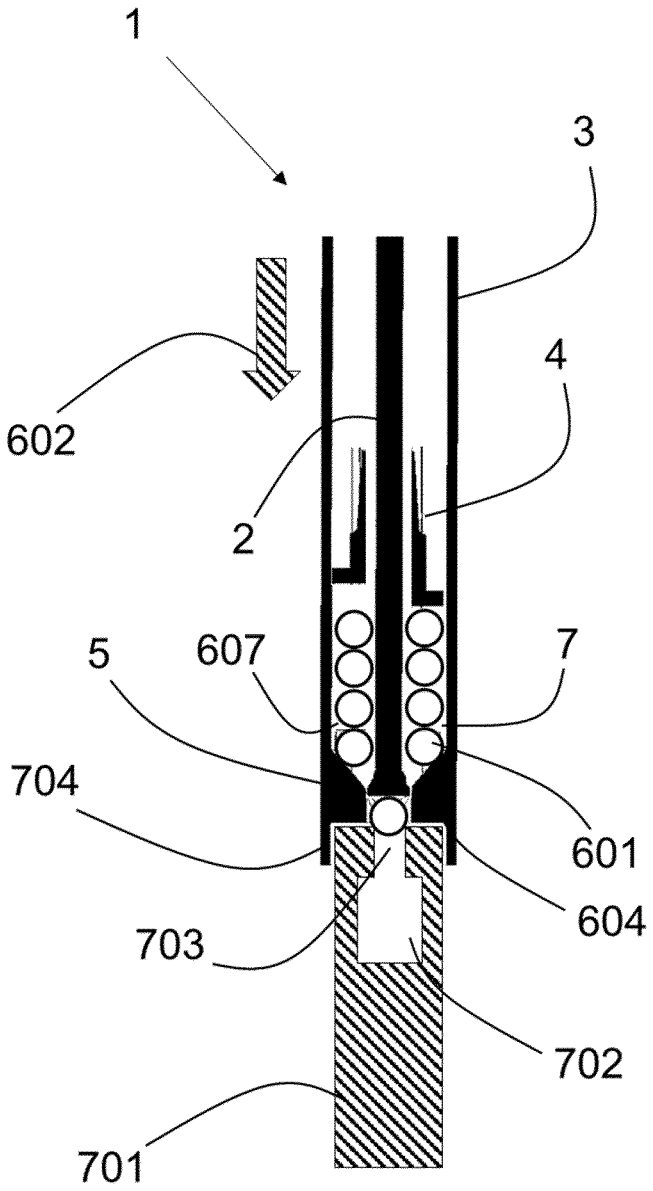
FIGS. 7A and 7B show how a dispenser in accordance with the present invention is able to insert a filter component into a smoking article having a mouth end recess.
Figure 7B:
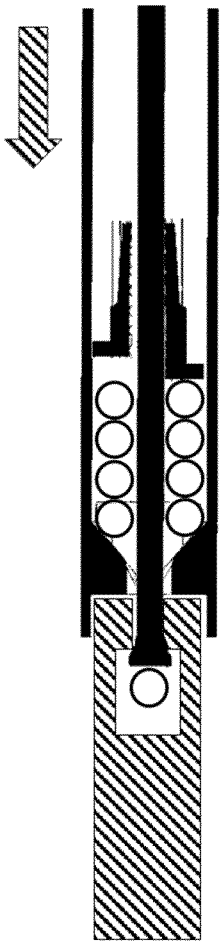

FIGS. 7A and 7B show how a dispenser in accordance with the present invention is able to insert a filter component into a smoking article having a mouth end recess. The numbered features in FIGS. 7A and 7B correspond to the same numbered features labelled in FIG. 6A. In addition, FIGS. 7A and 7B show the mouth end of a smoking article 701. The mouth end of the smoking article 701 is formed from filtration material, for example cellulose acetate. The mouth end of the smoking article comprises a two part recess extending from its mouth end. The recess comprises a wider section 702 and a narrower section 703. The wider section 702 has an internal diameter greater than the diameter of a single filter component 601. The narrower section 703 has an internal diameter less than the diameter of a single filter component 601. The wider section 702 and the narrower section 703 of the recess are formed by two aligned hollow tubes having different internal diameters.

FIGS. 7A and 7B also show how the mouth end of a smoking article 701 is received by the receiving section 704 of the dispenser 1 which aligns the recess of the smoking article 701 with the exit orifice 5 of the dispenser 1.

FIG. 7A shows the dispenser in a configuration immediately before the filter component 601 is pushed by the rod 2 through the exit orifice 5. At this stage, the carriage is no longer advancing.

FIG. 7B shows the dispenser in a configuration immediately after the filter component 601 has been inserted into the recess of the smoking article 701. The filter component is pushed through the narrower section 703 of the recess by the rod. As this occurs, one or more of the filter component 601 and the hollow tube defining the narrower section 703 of the recess deform to allow the filter component to pass through the narrower section 703 of the recess and into the wider section 702 of the recess where it is retained. As this happens, the rod 2 also passed through the narrow section 703 of the recess and eventually into the wider section 702 of the recess where it reaches its most extended position.

The invention claimed is:

1. A dispenser for dispensing a filter component, comprising, a housing defining an exit orifice and;

a rod at least partially disposed within the housing, the rod having a first end face, wherein the rod is movable between:

a retracted position in which the first end face of the rod is fully disposed within the housing and in which the rod is unable to move further rearwards, and an extended position in which the first end face of the rod is disposed outside the housing and wherein when the rod is moved between the retracted position and the extended position, the first end face of the rod passes through the exit orifice; and wherein the dispenser further comprises a loading zone for accommodating only a single filter component when the rod is in the retracted position, the loading zone being disposed between the exit orifice and the first end face of the rod when the rod is in the retracted position.

2. A dispenser according to claim 1, further comprising a receiving section for receiving an end of a smoking article and aligning said end with the exit orifice.

3. A kit of parts comprising a dispenser according to claim 1, and a smoking article, the smoking article comprising a filter section having a mouth end recess, wherein the recess is configured to retain at least one filter component.

4. A dispenser according to claim 1, wherein the exit orifice comprises an exit orifice restricting element for restricting the exit of filter components from the dispenser.

5. A dispenser according to claim 1, further comprising a first storage zone disposed within the housing for storing a plurality of filter components, wherein the first storage zone is axially misaligned with the rod.

6. A dispenser according to claim 5, further comprising a second storage zone disposed within the housing for storing a plurality of filter components, wherein the second storage zone is axially misaligned with the rod.

7. A dispenser according to claim 6, further comprising a carriage configured to advance filter components along the first storage zone towards the exit orifice.

8. A dispenser according to claim 7, wherein the carriage comprises a rod engagement mechanism configured to engage with at least one toothed section of the rod.

9. A dispenser according to claim 7, wherein the carriage comprises a housing engagement mechanism configured to engage with at least one toothed section of the housing.

10. A dispenser according to claim 7, wherein the first and second storage zones each have a respective length in the longitudinal direction of the dispenser, and wherein the length of the first storage zone differs from the length of the second storage zone.

11. A dispenser according to claim 10, wherein the carriage comprises a first face defining a rear end of the first storage zone, and a second face defining a rear end of the second storage zone, and wherein the first face of the carriage is longitudinally off-set from the second face of the carriage.

12. A dispenser according to claim 5, wherein at least a portion of the front end of the rod extends towards the first storage zone.

13. A dispenser according to claim 5, wherein the first storage zone is at least partially defined by a surface portion of the rod.

14. A dispenser according to claim 13, wherein the surface portion of the rod adjacent the first storage zone generally has an arc shaped surface cross section.

* * * * *